US012753466B2

(12) United States Patent
Soeda et al.

(10) Patent No.: US 12,753,466 B2
(45) Date of Patent: Oct. 6, 2026

(54) RESISTOR AND MANUFACTURING METHOD THEREOF

(71) Applicant: DAIDO STEEL CO., LTD., Nagoya (JP)

(72) Inventors: Ryoga Soeda, Nagoya (JP); Yuki Nakamura, Nagoya (JP); Hiroyuki Miyamoto, Nagoya (JP)

(73) Assignee: Daido Steel Co., Ltd., Nagoya (JP)

( * ) Notice: Subject to any disclaimer, the term of this patent is extended or adjusted under 35 U.S.C. 154(b) by 14 days.

(21) Appl. No.: 18/631,759

(22) Filed: Apr. 10, 2024

(65) Prior Publication Data

US 2024/0344181 A1 Oct. 17, 2024

(30) Foreign Application Priority Data

Apr. 11, 2023 (JP) ..... 2023-064521

(51) Int. Cl.
*C22C 19/05* (2006.01)
*C22C 1/02* (2006.01)
*C22F 1/10* (2006.01)

(52) U.S. Cl.
CPC ..... *C22C 19/058* (2013.01); *C22C 1/02* (2013.01); *C22F 1/10* (2013.01)

(58) Field of Classification Search
None
See application file for complete search history.

(56) References Cited

U.S. PATENT DOCUMENTS

| | | | |
|---|---|---|---|
| 2,293,878 A | 8/1942 | Victor et al. | |
| 2,638,425 A | 5/1953 | Victor et al. | |
| 3,571,778 A | 3/1971 | Smith, Jr. | |
| 2010/0172790 A1 | 7/2010 | Hattendorf et al. | |
| 2013/0200068 A1 | 8/2013 | Hattendorf et al. | |
| 2021/0193356 A1* | 6/2021 | Marien | H01C 17/06526 |

FOREIGN PATENT DOCUMENTS

| | | |
|---|---|---|
| CN | 115094274 A | 9/2022 |
| EP | 4 682 289 A1 | 1/2026 |
| JP | S35-008458 B | 7/1960 |

(Continued)

OTHER PUBLICATIONS

CAB Worldwide, "Correlation of Hardness Values to Tensile Strength", Jun. 2024, <https://www.cabww.com/wp-content/uploads/2024/06/CorrelationHardnessTensile-wp.pdf>, accessed May 29, 2025. (Year: 2024).*

(Continued)

*Primary Examiner* — Xiaobei Wang
(74) *Attorney, Agent, or Firm* — McGinn IP Law Group, PLLC

(57) ABSTRACT

The present invention relates to a resistor including a Ni-based alloy that consists of 15.0 mass %≤Cr≤25.0 mass %, 1.0 mass %≤Al≤4.0 mass %, 1.0 mass %≤Cu≤3.0 mass %, 0 mass %≤Si≤1.5 mass %, and 0 mass %≤Mn≤1.5 mass %, with the balance being Ni and inevitable impurities, in which the resistor has a Vickers hardness at 20° C. of 160 Hv or more and 230 Hv or less, a volume resistivity at 20° C. of 125 μΩ·cm or more and 150 μΩ·cm or less, and a temperature coefficient of resistance at 20° C. to 155° C. of −50 ppm/° C. or more and 10 ppm/° C. or less, and relates to a manufacturing method thereof.

17 Claims, 3 Drawing Sheets

(56) References Cited

FOREIGN PATENT DOCUMENTS

| | | | | | |
|---|---|---|---|---|---|
| JP | S43-017499 | B | | 7/1968 | |
| JP | S44-028783 | B | | 11/1969 | |
| JP | H04-52243 | A | * | 2/1992 | ..... C22C 19/05 |
| JP | H04-052243 | A | | 2/1992 | |
| JP | 2010-532425 | T | | 10/2010 | |
| JP | 2022-022731 | A | | 2/2022 | |
| WO | 2024/195588 | A1 | | 9/2024 | |

OTHER PUBLICATIONS

Lamineries Matthey, "Evanhom", 2024, <https://www.matthey.ch/fileadmin/user_upload/downloads/fichetechnique/EN/EvanohmR_v24E.pdf>, accessed Feb. 27, 2026. (Year: 2024).*

Japanese Information Offer for Japanese Application No. 2023-064521 dated Nov. 27, 2024 with English translation (issued on Jan. 7, 2025).

Carpenter Electrification EVANOHM® R Datasheet, <URL: https://www.carpenterelectrification.com/resources> (2020).

Japanese Office Action, dated Nov. 5, 2024 in Japanese Application No. 2023-064521 with English Translation thereof.

German Office Action dated Jul. 24, 2026 in German Patent Application No. 10 2024 109 845.7 with machine English translation.

JIS Z 2244-1 Standard:2020. Vickers hardness test—Part 1: Test method, pp. 1-7, English translation.

JIS Z 2244-1 Standard:2020/Erratum 1 2021-05-00. Vickers hardness test—Part 1: Test method. URL: https://webdesk.jsa.or.jp/pdf/errata/E202106/jis_z_02244_001_000_2020_cor_1_202105_e_ch.pdf.

* cited by examiner

RESISTOR AND MANUFACTURING METHOD THEREOF

CROSS-REFERENCE TO RELATED APPLICATIONS

This application is based on and claims priority under 35 USC 119 from Japanese Patent Application No. 2023-064521 filed on Apr. 11, 2023, the content of which is incorporated herein by reference.

TECHNICAL FIELD

The present invention relates to a resistor and a manufacturing method thereof, and more particularly to a resistor having an appropriate hardness, an appropriate volume resistivity, and an appropriate temperature coefficient of resistance, and a manufacturing method thereof.

BACKGROUND ART

In recent years, along with an increase in performance and development of power supply devices, electric vehicles, and the like, there is an increasing demand for precision resistance materials, particularly resistance materials having high volume resistivity and low temperature coefficient of resistance. Further, along with the spread of SiC power devices whose operable temperature is higher than that of Si power devices in the related art, resistance materials are also required to have characteristic stability at 150° C. or higher. Therefore, various proposals have been made in the related art regarding such resistance materials.

For example, Patent Literature 1 discloses an alloy for precision electrical resistance obtained by (a) melting an alloy consisting of a predetermined amount of Cr, Al, Mn, and Si, and the balance being Ni,
(b) processing a molten material into a predetermined shape, and
(c) subjecting a processed material to a solution treatment at 900° C. for 30 minutes.

This literature describes that when a predetermined amount of Si is added to a Ni—Cr—Al-based alloy for precision electrical resistance, an aging treatment required in the related art can be omitted, and mechanical properties and electrical characteristics can be adjusted only by the solution treatment.

Patent Literature 2 discloses a precision resistance alloy obtained by (a) melting Ni-25 mass % Cr-3 mass % Cu-3 mass % Al,
(b) subjecting a molten material to a homogenization heat treatment and cold working, and
(c) heating a cold-worked material at 1,000° C. for 1 hour and then performing furnace cooling at 300° C./Hr.

This literature describes that a precision resistance alloy having a specific electrical resistance of 114 μΩ·cm (20° C.) and a temperature coefficient (TCR) of specific electrical resistance of $+90\times10^{-6}$/° C. (0° C. to 50° C.) can be obtained by such a method.

Patent Literature 3 discloses a resistance wire consisting of Ni-19 mass % Cr-3 mass % Al-1 mass % Mn.

This literature describes that when a predetermined amount of Mn is added to a Ni—Cr-based precision resistance wire, an alloy intrinsic resistance value increases and a temperature coefficient decreases.

Patent Literature 4 discloses a Ni alloy for precision resistance consisting of Ni-19 mass % Cr-3 mass % Mn-3 mass % Al-1 mass % Si.

This literature describes that when a predetermined amount of Si is added to a Ni—Mn—Cr—Al alloy, an intrinsic electrical resistance increases without increasing a temperature coefficient of resistance.

Patent Literature 5 discloses an electrical resistance alloy consisting of Ni-4 mass % Al-2 mass % Cu-20 mass % Cr.

This literature describes that the electrical resistance alloy has a resistance of about 900 ohms per circular mil foot at 20° C. and a temperature coefficient of resistance of $7\times10^{-6}$ ohms/ohms/° C.

Patent Literature 6 discloses an electrical resistance alloy consisting of Ni-20 mass % Cr-1.5 mass % Cu-1.5 mass % Al.

This literature describes that the electrical resistance alloy has a resistance of about 668 ohms (C.M.F.) and a temperature coefficient of resistance of $33\times10^{-6}$ ohms.

A metal thin film resistor made of a Cu—Mn-based alloy or the like having a small temperature coefficient of resistance has been used as a precision resistance material in the related art. However, the Cu—Mn-based alloy in the related art has a problem that the volume resistivity is small.

On the other hand, a Ni—Cr—Al-based alloy generally has a small temperature coefficient of resistance and a large volume resistivity. However, in the Ni—Cr—Al-based alloy in the related art, when manufacturing conditions are inappropriate, the temperature coefficient of resistance may increase, or the hardness may increase excessively and the workability may decrease.

Further, there has been no example in the related art in which a resistor having an appropriate hardness, an appropriate volume resistivity, and an appropriate temperature coefficient of resistance is proposed.

Patent Literature 1: JPS44-028783B
Patent Literature 2: JPH04-052243A
Patent Literature 3: JPS35-008458B
Patent Literature 4: JPS43-017499B
Patent Literature 5: U.S. Pat. No. 2,293,878
Patent Literature 6: U.S. Pat. No. 2,638,425

SUMMARY OF INVENTION

An object of the present invention is to provide a resistor having an appropriate hardness, an appropriate volume resistivity, and an appropriate temperature coefficient of resistance.

Another object of the present invention is to provide a manufacturing method of such a resistor.

In order to solve the above-mentioned problems, the resistor according to the present invention has the following configurations.

(1) A resistor includes a Ni-based alloy that consists of $$15.0 \text{ mass } \% \leq \text{Cr} \leq 25.0 \text{ mass } \%,$$

$$1.0 \text{ mass } \% \leq \text{Al} \leq 4.0 \text{ mass } \%,$$

$$1.0 \text{ mass } \% \leq \text{Cu} \leq 3.0 \text{ mass } \%,$$

$$0 \text{ mass } \% \leq \text{Si} \leq 1.5 \text{ mass } \%, \text{ and}$$

$$0 \text{ mass } \% \leq \text{Mn} \leq 1.5 \text{ mass } \%,$$

with the balance being Ni and inevitable impurities, (2) The resistor has a Vickers hardness at 20° C. of 160 Hv or more and 230 Hv or less, a volume resistivity at 20° C. of 125μΩ·cm or more and 150μΩ·cm or less, and a temperature coefficient of resistance at 20° C. to 155° C. of −50 ppm/° C. or more and 10 ppm/° C. or less.

A manufacturing method of the resistor according to the present invention, the method including:

a melting and casting step of melting and casting raw materials to obtain an ingot consisting of $$15.0 \text{ mass } \% \leq Cr \leq 25.0 \text{ mass } \%,$$

$$1.0 \text{ mass } \% \leq Al \leq 4.0 \text{ mass } \%,$$

$$1.0 \text{ mass } \% \leq Cu \leq 3.0 \text{ mass } \%,$$

$$0 \text{ mass } \% \leq Si \leq 1.5 \text{ mass } \%, \text{ and}$$

$$0 \text{ mass } \% \leq Mn \leq 1.5 \text{ mass } \%,$$

with the balance being Ni and inevitable impurities;

a homogenization heat treatment step of performing a homogenization heat treatment on the ingot to obtain a heat-treated body;

a hot working step of performing hot working on the heat-treated body to obtain a hot-formed body;

a cold working step of performing cold working on the hot-formed body to obtain a cold-formed body; and a heat treatment step of performing a heat treatment for removing strain and controlling a precipitation amount of a γ′ phase and a formation amount of a short-range ordered phase on the cold-formed body, to obtain the resistor according to the present invention.

The heat treatment step may include: a solution treatment step of holding the cold-formed body at a heating temperature of 800° C. or higher and 1,200° C. or lower for 30 seconds or longer and 3 hours or shorter, followed by cooling within a temperature section from the heating temperature to 400° C. at an average cooling rate at which the resistor according to the present invention is obtained.

Alternatively, the heat treatment step may include:

a solution treatment step of holding the cold-formed body at a heating temperature of 800° C. or higher and 1,200° C. or lower for 30 seconds or longer and 3 hours or shorter, followed by cooling within a temperature section from the heating temperature to 400° C. at an average cooling rate exceeding an average cooling rate of air cooling to obtain a solution-treated body; and an annealing step of holding the solution-treated body at a heating temperature of 200° C. or higher and 700° C. or lower for 30 seconds or longer and 5 hours or shorter to obtain the resistor according to the present invention.

The hardness, the volume resistivity, and the temperature coefficient of resistance (TCR) of the resistor according to the present invention depend not only on the composition of the resistor, but also on the precipitation amount of the γ′ phase ($Ni_3Al$ phase) and the formation amount of the short-range ordered phase (SRO) in the resistor. The precipitation amount of the γ′ phase and the formation amount of SRO depend on heat treatment conditions. Therefore, when the heat treatment conditions are optimized in addition to optimization of the composition, a resistor having an appropriate hardness, an appropriate volume resistivity, and an appropriate temperature coefficient of resistance can be obtained.

DESCRIPTION OF EMBODIMENTS

Figure 1:
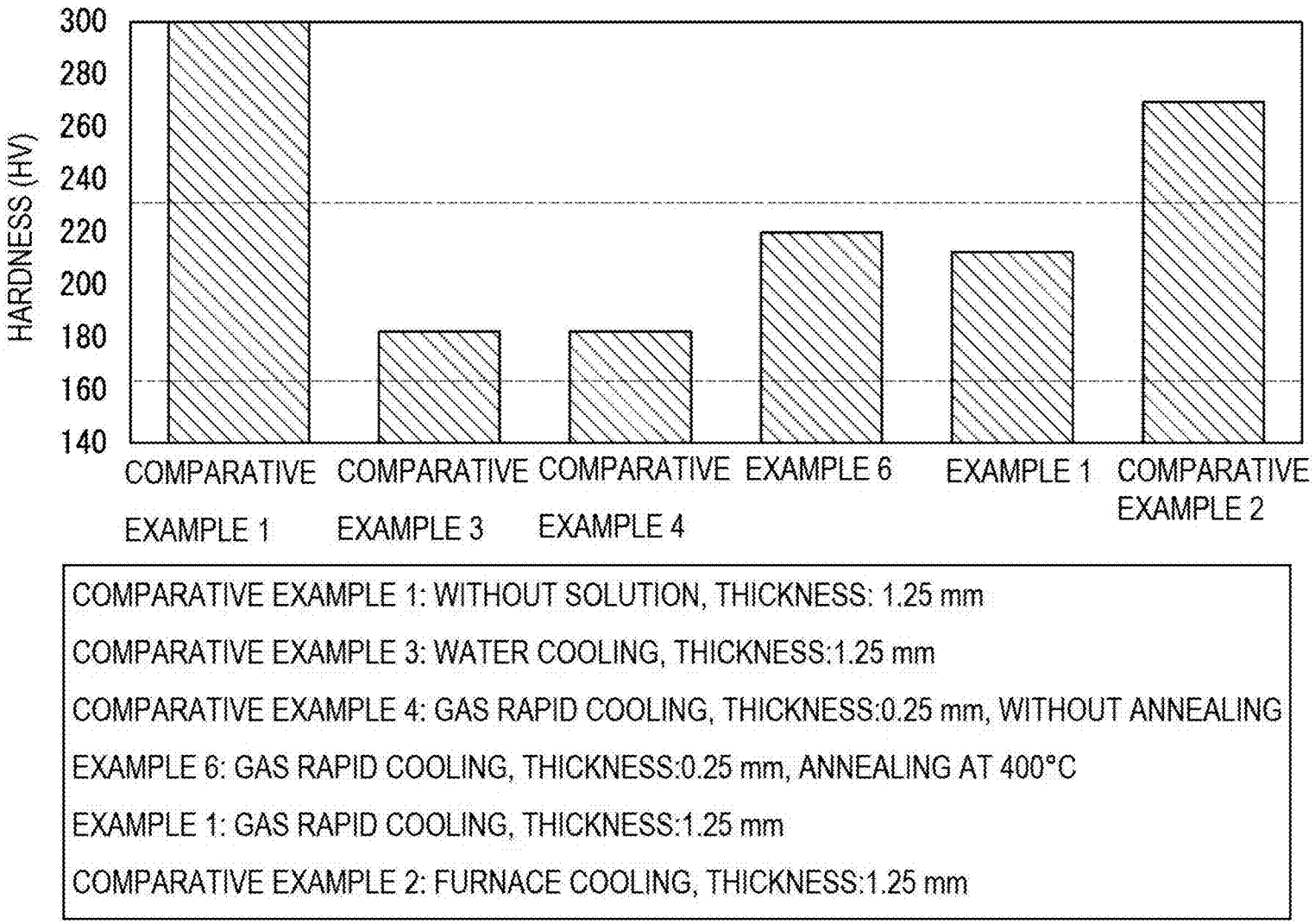
FIG. 1 shows a hardness of each of resistors obtained in Examples 1 and 6 and Comparative Examples 1 to 4.

Hereinafter, an embodiment of the present invention will be described in detail.

[1. Ni-Based Alloy]

[1.1. Main Components]

A resistor according to the present invention includes a Ni-based alloy. The Ni-based alloy consists of the following elements, with the balance being Ni and inevitable impurities. Types of added elements, component ranges thereof, and reasons for limitation thereof are as follows.

$$15.0 \text{ mass } \% \leq Cr \leq 25.0 \text{ mass } \%: \quad (1)$$

Cr is solid-soluted in Ni and has a function of increasing the volume resistivity and a function of decreasing an absolute value of the temperature coefficient of resistance. By forming a short-range ordered phase, the volume resistivity can be further increased and the absolute value of the temperature coefficient of resistance can be further decreased. In order to exert such an effect, an amount of Cr needs to be 15.0 mass % or more. The amount of Cr is preferably 18.0 mass % or more.

On the other hand, when the amount of Cr is excessive, the short-range ordered phase may be completely ordered to form a $Ni_2Cr$ phase. When the $Ni_2Cr$ phase is formed, effects of increasing the volume resistivity and decreasing the absolute value of the temperature coefficient of resistance due to the formation of the short-range ordered phase cannot be exerted. Therefore, the amount of Cr needs to be 25.0 mass % or less. The amount of Cr is preferably 22.0 mass % or less.

$$1.0 \text{ mass } \% \leq Al \leq 4.0 \text{ mass } \%: \quad (2)$$

Al is solid-soluted in Ni and has a function of increasing the volume resistivity and a function of decreasing the absolute value of the temperature coefficient of resistance. In order to exert such an effect, an amount of Al needs to be 1.0 mass % or more. The amount of Al is preferably 2.0 mass % or more.

On the other hand, when the amount of Al is excessive, a γ′ phase ($Ni_3Al$ phase) is prone to be formed. When an excessive γ′ phase is formed, the hardness excessively increases, and the workability may be impaired. Therefore, the amount of Al needs to be 4.0 mass % or less. The amount of Al is preferably 3.0 mass % or less.

$$1.0 \text{ mass } \% \leq Cu \leq 3.0 \text{ mass } \%: \quad (3)$$

Similarly to Al, Cu is solid-soluted in Ni and has a function of increasing the volume resistivity and a function of decreasing the absolute value of the temperature coefficient of resistance. In order to exert such an effect, an amount of Cu needs to be 1.0 mass % or more. The amount of Cu is preferably 1.5 mass % or more.

On the other hand, when the amount of Cu is excessive, the hot workability may be reduced. Therefore, the amount of Cu needs to be 3.0 mass % or less. The amount of Cu is preferably 2.5 mass % or less.

$$0 \text{ mass } \% \leq \text{Si} \leq 1.5 \text{ mass } \%: \quad (4)$$

Si is an element acting mainly as a deoxidizing agent during melting refining, and can be contained as necessary. Si also contributes to an increase in volume resistivity. An amount of Si is preferably 0.5 mass % or more.

On the other hand, when the amount of Si is excessive, the toughness and the hot workability may be reduced. Therefore, the amount of Si needs to be 1.5 mass % or less. The amount of Si is preferably 1.2 mass % or less.

$$0 \text{ mass } \% \leq \text{Mn} \leq 1.5 \text{ mass } \%: \quad (5)$$

Similarly to Si, Mn is an element acting mainly as a deoxidizing agent during melting refining, and can be contained as necessary. Mn also contributes to an increase in volume resistivity. An amount of Mn is preferably 0.5 mass % or more.

On the other hand, when the amount of Mn is excessive, the hot workability may be reduced. Therefore, the amount of Mn needs to be 1.5 mass % or less. The amount of Mn is preferably 1.2 mass % or less.

[1.2. Inevitable Impurities]

(6) C≤0.01 mass %:

(7) P≤0.01 mass %:

(8) S≤0.01 mass %:

(9) Mo≤0.1 mass %:

(10) W≤0.1 mass %:

(11) V≤0.1 mass %:

(12) Ti≤0.1 mass %:

(13) Fe≤0.5 mass %:

(14) O≤0.01 mass %:

(15) N≤0.01 mass %:

The Ni-based alloy according to the present invention may contain inevitable impurities. Examples of the inevitable impurities include C, P, S, Mo, W, V, Ti, Fe, O, and N. A content of these elements is preferably as small as possible. In order to suppress a decrease in electrical characteristics of the Ni-based alloy, it is preferable that the content of these elements is limited to the above-described content.

[2. Resistor]

The resistor according to the present invention includes a Ni-based alloy and has a Vickers hardness at 20° C. of 160 Hv or more and 230 Hv or less, a volume resistivity at 20° C. of 125 μΩ·cm or more and 150 μΩ·cm or less, and a temperature coefficient of resistance at 20° C. to 155° C. of −50 ppm/° C. or more and 10 ppm/° C. or less.

[2.1. Ni-Based Alloy]

A resistor according to the present invention includes a Ni-based alloy. Details of the Ni-based alloy are as described above, and descriptions thereof are omitted.

[2.2. Characteristics]

[2.2.1. Vickers Hardness]

The hardness of the resistor according to the present invention mainly depends on the precipitation amount of the γ′ phase. The precipitation amount of the γ′ phase mainly depends on a composition of the resistor and the heat treatment conditions (particularly, a cooling rate during the solution treatment). When the components and the heat treatment conditions are optimized, a resistor having a Vickers hardness at 20° C. of 160 HV or more and 230 Hv or less is obtained.

[2.2.2. Volume Resistivity]

The volume resistivity of the resistor according to the present invention mainly depends on the precipitation amount of the γ′ phase and the formation amount of the short-range ordered phase (SRO). The precipitation amount of the γ′ phase and the formation amount of SRO depend on the composition of the resistor and the heat treatment conditions (particularly, the cooling rate during the solution treatment and annealing conditions). When the components and the heat treatment conditions are optimized, a resistor having a volume resistivity at 20° C. of 125 μΩ·cm or more and 150μΩ·cm or less is obtained.

[2.2.3. Temperature Coefficient of Resistance]

The "temperature coefficient of resistance (TCR)" refers to a value represented by the following equation (1).

$$\text{TEMPERATURE COEFFICIENT OF RESISTANCE } (\text{ppm}/^\circ\text{ C.}) = \{(R-R_a)/R_a\} \times 10^6/(T-T_a) \quad (1)$$

Where, $R_a$ is a resistance value at a reference temperature,

R is a resistance value at any temperature, $T_a$ is a reference temperature (20° C. in the present invention), and T is any temperature (155° C. in the present invention).

The resistor according to the present invention is obtained by subjecting a Ni-based alloy of which components are optimized to an appropriate heat treatment. Therefore, the resistor according to the present invention has a smaller absolute value of the temperature coefficient of resistance and a higher thermal stability of the temperature coefficient of resistance than the resistor in the related art. When the components and the heat treatment conditions are optimized, a resistor having a temperature coefficient of resistance at 20° C. to 155° C. of −50 ppm/° C. or more and 10 ppm/° C. or less is obtained.

[2.2.4. Thickness]

The resistor according to the present invention has a high volume resistivity, a small absolute value of the temperature coefficient of resistance, and high workability. Therefore, the resistor can be easily processed into a thin ribbon shape. When manufacturing conditions are optimized, a resistor having a thickness of 3 mm or less is obtained.

[3. Manufacturing Method of Resistor]

A manufacturing method of a resistor according to the present invention includes:

a melting and casting step of melting and casting raw materials to obtain an ingot consisting of $$15.0 \text{ mass } \% \leq \text{Cr} \leq 25.0 \text{ mass } \%,$$

$$1.0 \text{ mass } \% \leq \text{Al} \leq 4.0 \text{ mass } \%,$$

$$1.0 \text{ mass } \% \leq \text{Cu} \leq 3.0 \text{ mass } \%,$$

$$0 \text{ mass } \% \leq \text{Si} \leq 1.5 \text{ mass } \%, \text{ and}$$

$$0 \text{ mass } \% \leq \text{Mn} \leq 1.5 \text{ mass } \%,$$

with the balance being Ni and inevitable impurities;

a homogenization heat treatment step of performing a homogenization heat treatment on the ingot to obtain a heat-treated body;

a hot working step of performing hot working on the heat-treated body to obtain a hot-formed body;

a cold working step of performing cold working on the hot-formed body to obtain a cold-formed body; and a heat treatment step of performing a heat treatment for removing strain and controlling a precipitation amount of a γ' phase and a formation amount of a short-range ordered phase on the cold-formed body, to obtain the resistor according to the present invention.

[3.1. Melting and Casting Step]

First, raw materials blended to obtain the resistor according to the present invention are melted and cast to thereby obtain an ingot (melting and casting step). Methods and conditions for melting and casting are not particularly limited, and known methods can be used.

[3.2. Homogenization Heat Treatment Step]

Next, the ingot is subjected to homogenization heat treatment to thereby obtain a heat-treated body (homogenization heat treatment step).

Since the resistor according to the present invention uses a Ni-based alloy containing a large amount of Cr, elements are likely to be segregated in a state of being casted. The homogenization heat treatment is performed to remove such segregation of elements.

When a temperature of the homogenization heat treatment is excessively low, segregation of elements cannot be sufficiently removed. Therefore, the heat treatment temperature is preferably 1,000° C. or higher. The heat treatment temperature is more preferably 1,100° C. or higher, and further more preferably 1,200° C. or higher.

On the other hand, when the heat treatment temperature is excessively high, oxidation proceeds rapidly, and removal of an oxide layer may be required. Therefore, the heat treatment temperature is preferably 1,250° C. or lower.

When a time of the homogenization heat treatment is excessively short, segregation of elements cannot be sufficiently removed. Therefore, the heat treatment time is preferably 4 hours or longer. The heat treatment time is more preferably 8 hours or longer, and further more preferably 16 hours or longer.

On the other hand, when the heat treatment time is excessively long, removal of an oxide layer may be required. Therefore, the heat treatment time is preferably 24 hours or shorter.

[3.3. Hot Working Step]

Next, the heat-treated body is subjected to hot working to thereby obtain a hot-formed body (hot working step). Hot working is performed to uniformize a structure and to work the structure into a rough shape. Methods and conditions of the hot working are not particularly limited as long as uniformization of a structure and working to a rough shape are possible.

A solution treatment may be performed after the hot working and before the cold working. When the solution treatment is performed before the cold working, there is an advantage that a material that is work hardened by the hot working is softened and the cold working can be easily performed.

[3.4. Cold Working Step]

Next, the hot-formed body is subjected to cold working to thereby obtain a cold-formed body (cold working step).

Generally, high thickness accuracy cannot be obtained only by hot working. The cold working is performed for working to a final thickness dimension. Methods and conditions of the cold working are not particularly limited as long as desired dimensional accuracy is obtained.

[3.5. Heat Treatment Step]

Next, the cold-formed body is subjected to a heat treatment to remove strain and control the precipitation amount of the γ' phase and the formation amount of the short-range ordered phase (heat treatment step). Thus, the resistor according to the present invention is obtained.

In order to obtain a high volume resistivity and a stable temperature coefficient of resistance, it is necessary to generate a short-range ordered phase in the Ni-based alloy. In a cooling process after the hot working, such a short-range ordered phase may be generated. However, since the short-range ordered phase is broken by the cold working, the volume resistivity is small and the absolute value of the temperature coefficient of resistance is large in the state of the cold working. Even when the cooling rate during the heat treatment after the cold working is high and generation of the short-range ordered phase is insufficient, the volume resistivity is small and the absolute value of the temperature coefficient of resistance is large. Further, when the strain is not sufficiently removed by the heat treatment after the cold working, the strain is gradually relaxed under the use environment, and the volume resistivity and the temperature coefficient of resistance change.

Therefore, it is necessary to sufficiently reform the short-range ordered phase that disappears by cold working, thereby increasing the volume resistivity and decreasing the absolute value of the temperature coefficient of resistance. It is necessary to sufficiently remove the residual strain simultaneously.

However, the heat treatment is preferably performed under conditions in which the γ' phase is not excessively precipitated. When the heat treatment is performed under the conditions in which the γ' phase is excessively precipitated, the volume resistivity decreases, the absolute value of the temperature coefficient of resistance increases, and the hardness of the resistor may be excessively increased.

Specific examples of a heat treatment method include the following methods.

[3.5.1. First Method]

The heat treatment step may include a solution treatment step of holding the cold-formed body at a heating temperature of 800° C. or higher and 1,200° C. or lower for 30 seconds or longer and 3 hours or shorter, followed by cooling within a temperature section from the heating temperature to 400° C. at an average cooling rate at which the resistor according to the present invention is obtained.

Here, the "solution treatment" refers to a treatment in which (a) the cold-formed body is held at a relatively high solution treatment temperature for a relatively short time to form a solid solution in which macroscopically, elements are uniformly solid-soluted and the ordered phase disappears, and (b) then, the solid solution is cooled from the solution treatment temperature at a predetermined average cooling rate to form a short-range ordered phase in the cooling process.

The "average cooling rate" refers to a value ($=\Delta T/t$) obtained by dividing a temperature difference ($\Delta T$) in the section from the heating temperature to 400° C. by a time (t) required for cooling.

When the temperature of the solution treatment is excessively low, removal of strain and solid-solution of elements become insufficient. Therefore, the treatment temperature is preferably 800° C. or higher. The treatment temperature is more preferably 1,000° C. or higher.

On the other hand, when the temperature of the solution treatment is excessively high, crystal grains may rapidly grow and the material strength may decrease. Therefore, the treatment temperature is preferably 1,200° C. or lower. The treatment temperature is more preferably 1,100° C. or lower.

When the time of the solution treatment is excessively short, the removal of strain and the solid solution of elements become insufficient. Therefore, the heat treatment time is preferably 30 seconds or longer. The heat treatment time is more preferably 60 seconds or longer, and further more preferably 90 seconds or longer.

On the other hand, when the time of the solution treatment is excessively long, the crystal grains may grow and the material strength may decrease. Therefore, the heat treatment time is preferably 3 hours or shorter.

When the average cooling rate is excessively slow, the γ' phase ($Ni_3Al$ phase) is precipitated during cooling, and the hardness increases. Precipitation of the γ' phase also leads to a decrease in volume resistivity and an increase in absolute value of the temperature coefficient of resistance. On the other hand, when the average cooling rate is excessively high, the formation of the short-range ordered phase is insufficient, a sufficiently large volume resistivity is not obtained, and the absolute value of the temperature coefficient of resistance is also large. Therefore, when only the solution treatment is performed, it is preferable to select an optimum value for the average cooling rate so as to obtain the resistor according to the present invention.

The average cooling rate during the solution treatment depends not only on the cooling method but also on the shape of the cold-formed body. For example, when a thickness of the cold-formed body is 2 mm or less, precipitation of the γ' phase may be suppressed only by performing air cooling after heating the cold-formed body to the solution treatment temperature.

On the other hand, when the thickness of the cold-formed body exceeds 2 mm, in the case where the cold-formed body is heated to the solution treatment temperature, followed by air-cooling, the excessive γ' phase may be precipitated in the cooling process, and the hardness may increase. In such a case, it is preferable to perform cooling using a cooling method capable of obtaining an average cooling rate exceeding the average cooling rate of air cooling. Examples of such a cooling method include gas rapid cooling.

However, when water cooling is performed, formation of the short-range ordered phase becomes insufficient. As a result, the volume resistivity may decrease excessively, and the absolute value of the temperature coefficient of resistance may increase. Therefore, it is preferable that the average cooling rate exceeds the average cooling rate of air cooling and is less than the average cooling rate of water cooling. The average cooling rate exceeding the average cooling rate of air cooling may be, for example, 100° C./min or more. The average cooling rate of less than the average cooling rate of water cooling is, for example, less than 60,000° C./min. By using the above gas rapid cooling, the average cooling rate may be 100° C./min or more and 10,000° C./min or less.

[3.5.1. Second Method]

The heat treatment step may include:

a solution treatment step of holding the cold-formed body at a heating temperature of 800° C. or higher and 1,200° C. or lower for 30 seconds or longer and 3 hours or shorter, followed by cooling within a temperature section from the heating temperature to 400° C. at an average cooling rate exceeding the average cooling rate of air cooling to obtain a solution-treated body, and an annealing step of holding the solution-treated body at a heating temperature of 200° C. or higher and 700° C. or lower for 30 seconds or longer and 5 hours or shorter to obtain the resistor according to the present invention.

That is, in the heat treatment step, the resistor according to the present invention may be obtained by a solution treatment and annealing.

[A. Solution Treatment]

As described above, when the cold-formed body is heated to the solution treatment temperature and then the heated cold-formed body is water cooled, the volume resistivity may excessively decrease and the absolute value of the temperature coefficient of resistance may increase. However, in the second method, an annealing treatment is performed after the solution treatment. When annealing conditions are optimized, an appropriate short-range ordered phase is formed, the volume resistivity increases, and the absolute value of the temperature coefficient of resistance decreases. Therefore, in the second method, the cooling method during the solution treatment may be water cooling.

Other points relating to the solution treatment are the same as those in the first method, and therefore, descriptions thereof will be omitted.

[B. Annealing Treatment]

The "annealing treatment" refers to a treatment in which the cold-formed body is subjected to the solution treatment, and then the solution-treated body is held at a predetermined annealing temperature for a relatively long time, thereby removing the strain introduced during the solution treatment and forming the short-range ordered phase at the same time.

When the annealing temperature is excessively low, the short-range ordered phase cannot be sufficiently formed within a realistic annealing time. Therefore, the annealing temperature is preferably 200° C. or higher.

On the other hand, when the annealing temperature is excessively high, the γ' phase ($Ni_3Al$ phase) is precipitated, ordering proceeds excessively, or a part or all of a metal structure is in a solid solution state, and thus the ordered phase is disappeared.

As a result, the volume resistivity may decrease or an absolute value of a resistance change rate may increase. Therefore, the annealing temperature is preferably 700° C. or lower.

When the annealing time is excessively short, the formation of the short-range ordered phase becomes insufficient. Therefore, the annealing time is preferably 30 seconds or longer. The annealing time is more preferably 60 seconds or longer, and further more preferably 90 seconds or longer.

On the other hand, when the annealing time is excessively long, the productivity deteriorates. Therefore, the annealing time is preferably 5 hours or shorter. The annealing time is more preferably 4 hours or shorter, and further more preferably 3 hours or shorter.

[4. Effects]

The hardness, the volume resistivity, and the temperature coefficient of resistance (TCR) of the resistor according to the present invention depend not only on the composition of the resistor, but also on the precipitation amount of the γ' phase ($Ni_3Al$ phase) and the formation amount of the short-range ordered phase (SRO) in the resistor. The precipitation amount of the γ' phase and the formation amount of SRO depend on heat treatment conditions. Therefore, when the heat treatment conditions are optimized in addition to optimization of the composition, a resistor having an appropriate hardness, an appropriate volume resistivity, and an appropriate temperature coefficient of resistance can be obtained.

Specifically, the lower the cooling rate during the solution treatment, the higher the hardness of the resistor. A reason is considered to be that the precipitation amount of the γ' phase increases as the cooling rate decreases.

In addition, as the cooling rate during the solution treatment decreases, the volume resistivity increases and the absolute value of TCR decreases. A reason is considered to be that the formation amount of SRO increases as the cooling rate decreases.

However, when the cooling rate during the solution treatment is excessively low, the volume resistivity may decrease and the absolute value of the TCR may increase. A reason is considered to be that when the cooling rate becomes excessively slow, the γ' phase is excessively precipitated in the cooling process.

When annealing is performed after the solution treatment, in the case where the annealing temperature is 500° C. or higher, the hardness of the resistor may increase. A reason is considered to be that the γ' phase precipitates during annealing.

Further, when annealing is performed after the solution treatment, the volume resistivity increases and the absolute value of TCR decreases as the annealing temperature increases. A reason is considered to be that the formation amount of SRO increases as the annealing temperature increases.

However, when the annealing temperature is excessively high, the volume resistivity may decrease and the absolute value of TCR may increase. A reason is considered to be that when the annealing temperature is excessively high, the γ' phase is excessively precipitated.

EXAMPLES

Examples 1 to 6 and Comparative Examples 1 to 6

[1. Preparation of Sample]

Raw materials blended to have compositions shown in Table 1 were melted in a vacuum induction heating furnace to obtain an ingot of 30 kg. Next, a homogenization treatment was performed by heating the ingot at 1,200° C. for 24 hours. Thereafter, forging was performed at 1,150° C. to form a plate shape having a thickness of 10 mm. In addition, the plate-shaped hot-formed body was subjected to a solution treatment of holding at 1,100° C. for 2 hours followed by air cooling. Further, the hot-formed body was cold rolled at room temperature to obtain a cold-formed body having a thickness of 1.25 mm or 0.25 mm.

TABLE 1

| | Composition (mass %) | | | | | |
|---|---|---|---|---|---|---|
| Alloy | Si | Mn | Cu | Cr | Al | Ni |
| Alloy 1 | 1.01 | 0.98 | 2.22 | 20.3 | 2.89 | Balance |
| Alloy 2 | 0.98 | 0.95 | 1.10 | 19.0 | 2.56 | Balance |
| Alloy 3 | 0.95 | 1.00 | 2.03 | 15.2 | 2.46 | Balance |
| Alloy 4 | 1.10 | 1.04 | 2.48 | 21.7 | 1.02 | Balance |

Next, the obtained cold-formed body was subjected to a solution treatment under predetermined conditions. Further, a part of the sample was annealed under predetermined conditions after the solution treatment.

[2. Test Method]

[2.1. Cutting out Test Piece]

A test piece for electrical resistance measurement of 1.25 mm×3 mm×90 mm or 0.25 mm×3 mm×90 mm (plate thickness was as being cold rolled) was cut out from the molded body after the heat treatment. For cutting out the test piece, discharge cutting was used to avoid introduction of strain due to cutting. A cutting direction was a direction in which a rolling direction matched a longitudinal direction of the test piece.

[2.2. Measurement of Volume Resistivity and Calculation of Temperature Coefficient of Resistance]

The volume resistivity (p) was measured by a four-terminal method using an electric resistance measurement system for metals and semiconductors TER-2000RH (manufactured by ADVANCE RIKO, Inc.). Measurement temperatures were 20° C. and 155° C.

The volume resistivity was measured three times at each temperature, and an average value was calculated. The measurement at 155° C. was performed after the temperature was increased at 5° C./s from 20° C. to 155° C., and after reaching 155° C., the temperature was maintained for 5 minutes. Further, the temperature coefficient of resistance was calculated using the above equation (1).

[2.3. Vickers Hardness]

The hardness was measured in accordance with the Vickers hardness test method defined in JIS Z2244-1:2020. The measurement was performed with a load of 4.9 N at a central position in a plate thickness direction. The measurement was performed at five points, and an average value thereof was adopted.

[3. Results]

Figure 2:
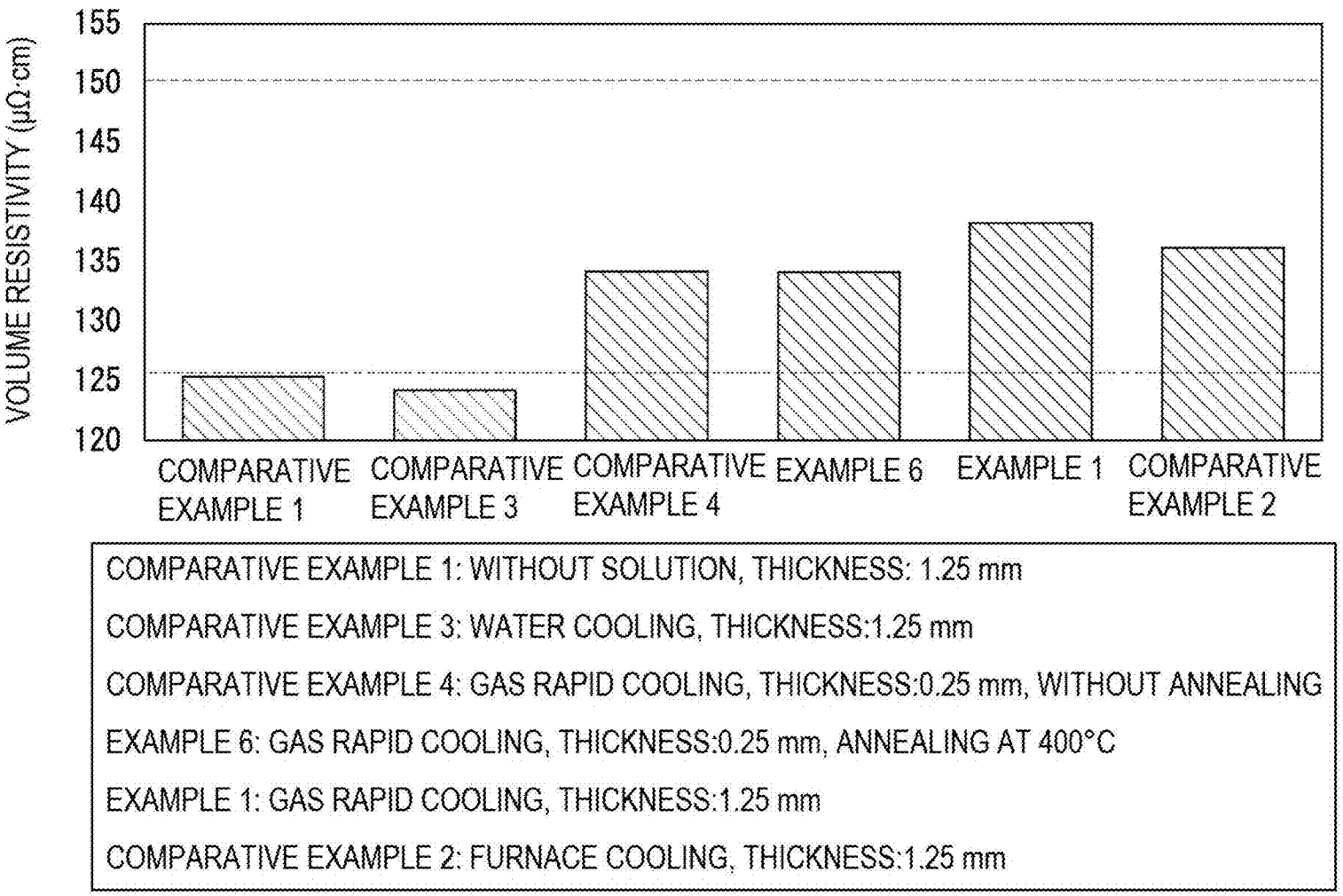
FIG. 2 shows a volume resistivity of each of the resistors obtained in Examples 1 and 6 and Comparative Examples 1 to 4.
Figure 3:
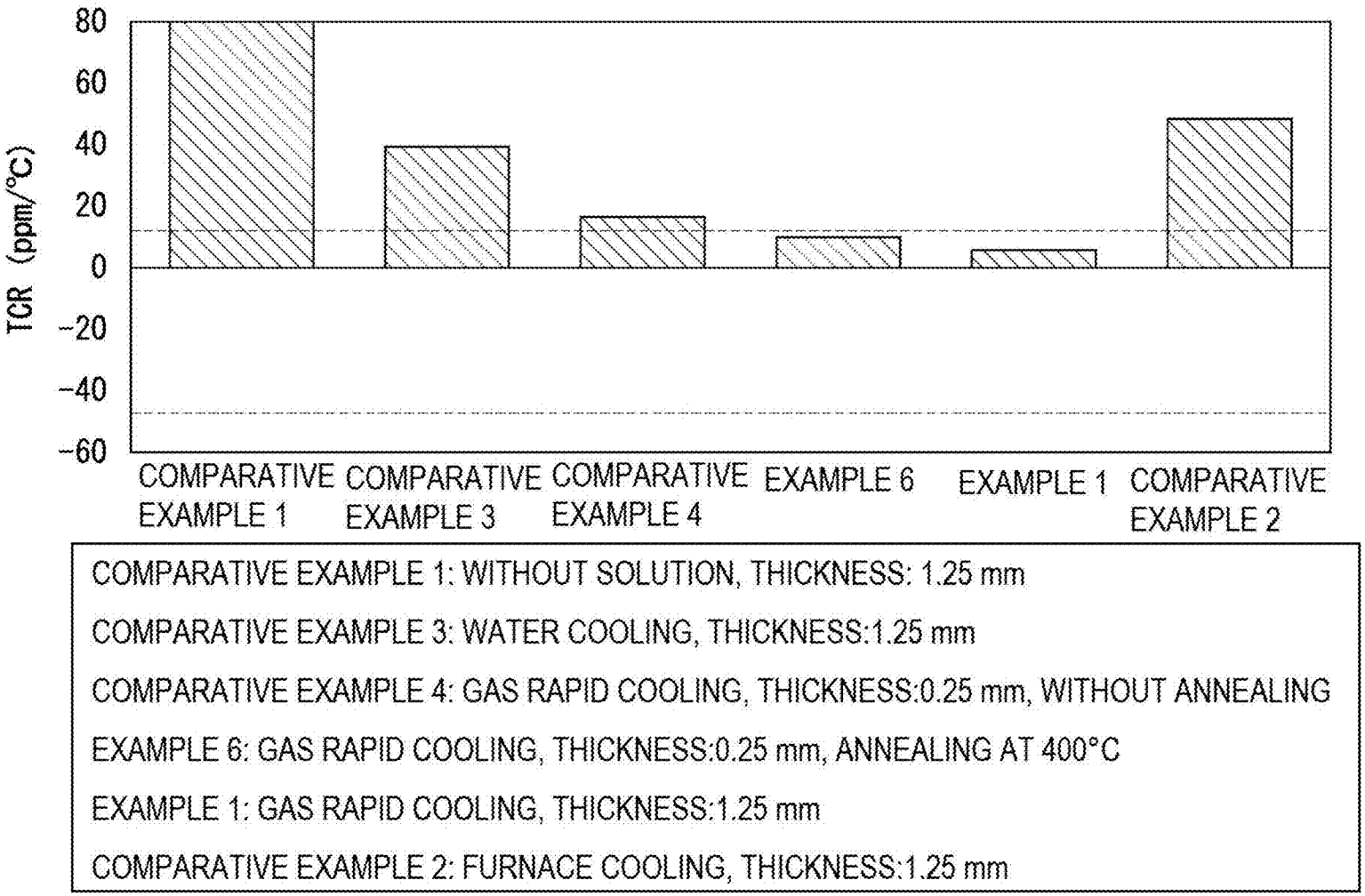
FIG. 3 shows a temperature coefficient of resistance of each of the resistors obtained in Examples 1 and 6 and Comparative Examples 1 to 4.

Results are shown in Table 2. Table 2 also shows heat treatment conditions. Further, FIGS. 1 to 3 show the hardness, the volume resistivity, and the temperature coefficient of resistance of resistors obtained in Examples 1 and 6 and Comparative Examples 1 to 4, respectively. From Table 2 and FIGS. 1 to 3, the following can be understood.

In Table 2, regarding the cooling method during the solution treatment, "furnace cooling" corresponds to an average cooling rate of about 50° C./min, "water cooling" corresponds to an average cooling rate of about 60,000° C./min, and "gas rapid cooling" corresponds to an average cooling rate of 100° C./min or more.

Regarding the hardness, "A" represents 170 Hv or more and 220 Hv or less, "B" represents 160 Hv or more and less than 170 HV, or more than 220 Hv and 230 Hv or less, and "C" represents less than 160 Hv or more than 230 Hv.

Regarding the volume resistivity, "A" represents 128μΩ·cm or more and 138μΩ·cm or less, "B" represents 125μΩ·cm or more and less than 128μΩ·cm, or more than 138μΩ·cm and 150μΩ·cm or less, and "C" represents less than 125μΩ·cm or more than 150μΩ·cm.

Regarding the temperature coefficient of resistance (TCR), "A" represents-10 ppm/° C. or more and 10 ppm/° C. or less, "B" represents −50 ppm/° C. or more and less than −10 ppm/° C., and "C" represents less than −50 ppm/° C. or more than 10 ppm/° C.

(1) In Comparative Example 1, the hardness exceeded 230 Hv and the TCR exceeded 10 ppm/° C.

A reason is considered to be that since the solution treatment was not performed, a large amount of γ' phase was contained.

(2) In Comparative Example 2, the hardness exceeded 230 Hv and the TCR exceeded 10 ppm/° C.

A reason is considered to be that since furnace cooling was performed during the solution treatment, the cooling rate became excessively slow, and a large amount of γ′ phase was precipitated in the cooling process.

(3) In Comparative Example 3, the volume resistivity was less than 125μΩ·cm, and the TCR exceeded 10 ppm/° C. A reason is considered to be that since water cooling was performed during the solution treatment, the cooling rate became excessively high, and the formation amount of SRO became small.

(4) In Comparative Example 4, the TCR exceeded 10 ppm/° C. A reason is considered to be that since the plate thickness of the resistor was thin, even when gas rapid cooling was used as the cooling method during the solution treatment, the average cooling rate became excessively high, and the formation amount of SRO became small.

(5) In Comparative Example 5, the hardness exceeded 230 Hv, and the TCR exceeded 10 ppm/° C.

A reason is considered to be that since annealing was performed at 800° C., a large amount of γ′ phase was precipitated during annealing.

(6) In Comparative Example 6, the TCR exceeded 10 ppm/° C. A reason is considered to be that since annealing was performed at 100° C., the formation amount of SRO was insufficient.

(7) Each of Examples 1 to 6 had an appropriate hardness, an appropriate volume resistivity, and an appropriate TCR.

TABLE 2

| | Alloy | Thickness (mm) | Solution treatment | Annealing | Hardness | ρ | TCR |
|---|---|---|---|---|---|---|---|
| Example 1 | Alloy 1 | 1.25 | 1,100° C./1 h/gas rapid cooling | Without | A | A | A |
| Example 2 | Alloy 2 | 1.25 | 1,100° C./1 h/gas rapid cooling | Without | A | A | A |
| Example 3 | Alloy 3 | 1.25 | 1,100° C./1 h/gas rapid cooling | Without | A | A | A |
| Example 4 | Alloy 4 | 1.25 | 1,100° C./1 h/gas rapid cooling | Without | A | A | A |
| Example 5 | Alloy 1 | 1.25 | 1,100° C./1 h/gas rapid cooling | 400° C./1 h | A | A | A |
| Example 6 | Alloy 1 | 0.25 | 1,100° C./1 h/gas rapid cooling | 400° C./1 h | A | A | A |
| Comparative example 1 | Alloy 1 | 1.25 | Without | Without | C | B | C |
| Comparative example 2 | Alloy 1 | 1.25 | 1,100° C./1 h/furnace cooling | Without | C | A | C |
| Comparative example 3 | Alloy 1 | 1.25 | 1,100° C./1 h/water cooling | Without | A | C | C |
| Comparative example 4 | Alloy 1 | 0.25 | 1,100° C./1 h/gas rapid cooling | Without | A | A | C |
| Comparative example 5 | Alloy 1 | 0.25 | 1,100° C./1 h/gas rapid cooling | 800° C./1 h | C | A | C |
| Comparative example 6 | Alloy 1 | 0.25 | 1,100° C./1 h/gas rapid cooling | 100° C./1 h | A | A | C |

Although the embodiment of the present invention has been described in detail above, the present invention is not limited to the above embodiment, and various modifications can be made without departing from the gist of the present invention.

The present application is based on Japanese Patent Application No. 2023-064521 filed on Apr. 11, 2023, and the contents thereof are incorporated herein by reference.

INDUSTRIAL APPLICABILITY

The resistor according to the present invention can be used as various resistors used in a power supply device, an electric vehicle, and the like.

What is claimed is:

1. A resistor comprising a Ni-based alloy that consists of $$15.0 \text{ mass } \% \leq \text{Cr} \leq 25.0 \text{ mass } \%,$$

$$1.0 \text{ mass } \% \leq \text{Al} \leq 4.0 \text{ mass } \%,$$

$$1.0 \text{ mass } \% \leq \text{Cu} \leq 3.0 \text{ mass } \%,$$

$$0 \text{ mass } \% \leq \text{Si} \leq 1.5 \text{ mass } \%, \text{ and}$$

$$0 \text{ mass } \% \leq \text{Mn} \leq 1.5 \text{ mass } \%,$$

with the balance being Ni and inevitable impurities, wherein the resistor has a Vickers hardness at 20° C. of 160 Hv or more and 230 Hv or less, a volume resistivity at 20° C. of 125μΩ·cm or more and 150μΩ·cm or less, and a temperature coefficient of resistance at 20° C. to 155° C. of −50 ppm/° C. or more and less than −10 ppm/° C.

2. The resistor according to claim 1, having a thickness of 3 mm or less.

3. The resistor according to claim 1, wherein the Ni-based alloy consists of 18.0 mass %≤Cr≤22.0 mass %.

4. The resistor according to claim 1, wherein the Ni-based alloy consists of 2.0 mass %≤Al≤3.0 mass %.

5. The resistor according to claim 1, wherein the Ni-based alloy consists of 1.5 mass %≤Cu≤2.5 mass %.

6. The resistor according to claim 1, wherein the Ni-based alloy consists of 0.5 mass %≤Si≤1.2 mass %.

7. The resistor according to claim 1, wherein the Ni-based alloy consists of 0.5 mass %≤Mn≤1.2 mass %.

8. The resistor according to claim 1, wherein the Ni-based alloy consists of 18.0 mass %≤Cr≤22.0 mass %, wherein the Ni-based alloy consists of 2.0 mass %≤Al≤3.0 mass %, and wherein the Ni-based alloy consists of 1.5 mass %≤Cu≤2.5 mass %.

9. The resistor according to claim 8, wherein the Ni-based alloy consists of 0.5 mass %≤Si≤1.2 mass %, and wherein the Ni-based alloy consists of 0.5 mass %≤Mn≤1.2 mass %.

10. The resistor according to claim 1, wherein the inevitable impurities include C≤0.01 mass %, P≤0.01 mass %, and S≤0.01 mass %.

11. The resistor according to claim 10, wherein the inevitable impurities further include Mo≤0.1 mass %, W≤0.1 mass %, V≤0.1 mass %, and Ti≤0.1 mass %.

12. The resistor according to claim 11, wherein the inevitable impurities further include Fe≤0.5 mass %, O≤0.01 mass %, and N≤0.01 mass %.

13. The resistor according to claim 1, wherein the Ni-based alloy does not contain a Ni2Cr phase.

14. The resistor according to claim 1, having a thickness of 2 mm or less.

15. A manufacturing method of a resistor comprising a Ni-based alloy that consists of:

$$15.0 \text{ mass } \% \leq Cr \leq 25.0 \text{ mass } \%,$$

$$1.0 \text{ mass } \% \leq Al \leq 4.0 \text{ mass } \%,$$

$$1.0 \text{ mass } \% \leq Cu \leq 3.0 \text{ mass } \%,$$

$$0 \text{ mass } \% \leq Si \leq 1.5 \text{ mass } \%, \text{ and}$$

$$0 \text{ mass } \% \leq Mn \leq 1.5 \text{ mass } \%,$$

with the balance being Ni and inevitable impurities, wherein the resistor has:

a Vickers hardness at 20° C. of 160 Hv or more and 230 Hv or less, a volume resistivity at 20° C. of 125μΩ·cm or more and 150μΩ·cm or less, and a temperature coefficient of resistance at 20° C. to 155° C. of −50 ppm/° C. or more and 10 ppm/° C. or less, the method comprising:

a melting and casting step of melting and casting raw materials to obtain an ingot consisting of $$15.0 \text{ mass } \% \leq Cr \leq 25.0 \text{ mass } \%,$$

$$1.0 \text{ mass } \% \leq Al \leq 4.0 \text{ mass } \%,$$

$$1.0 \text{ mass } \% \leq Cu \leq 3.0 \text{ mass } \%,$$

-continued $$0 \text{ mass } \% \leq Si \leq 1.5 \text{ mass } \%, \text{ and}$$

$$0 \text{ mass } \% \leq Mn \leq 1.5 \text{ mass } \%,$$

with the balance being Ni and inevitable impurities;

a homogenization heat treatment step of performing a homogenization heat treatment on the ingot to obtain a heat-treated body;

a hot working step of performing hot working on the heat-treated body to obtain a hot-formed body;

a cold working step of performing cold working on the hot-formed body to obtain a cold-formed body; and a heat treatment step of performing a heat treatment for removing strain and controlling a precipitation amount of a γ′ phase and a formation amount of a short-range ordered phase on the cold-formed body, to obtain the resistor.

16. The manufacturing method of a resistor according to claim 15, wherein the heat treatment step comprises:

a solution treatment step of holding the cold-formed body at a heating temperature of 800° C. or higher and 1,200° C. or lower for 30 seconds or longer and 3 hours or shorter, followed by cooling within a temperature section from the heating temperature to 400° C. at an average cooling rate exceeding an average cooling rate of furnace cooling but less than an average cooling rate of water cooling at which the resistor is obtained.

17. The manufacturing method of a resistor according to claim 15, wherein the heat treatment step comprises:

a solution treatment step of holding the cold-formed body at a heating temperature of 800° C. or higher and 1,200° C. or lower for 30 seconds or longer and 3 hours or shorter, followed by cooling within a temperature section from the heating temperature to 400° C. at an average cooling rate exceeding an average cooling rate of air cooling to obtain a solution-treated body; and an annealing step of holding the solution-treated body at a heating temperature of 200° C. or higher and 700° C. or lower for 30 seconds or longer and 5 hours or shorter to obtain the resistor.

* * * * *